US006240762B1

(12) United States Patent
Kan et al.

(10) Patent No.: US 6,240,762 B1
(45) Date of Patent: Jun. 5, 2001

(54) METHOD OF LEVELING STRIPS AND LEVELING EQUIPMENT OF STRIPS

(75) Inventors: Hiroyuki Kan; Keizo Abe, both of Niihama (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/497,762

(22) Filed: Feb. 4, 2000

(30) Foreign Application Priority Data

Feb. 15, 1999 (JP) ..... H11-035232

(51) Int. Cl.[7] ..... B21D 1/05
(52) U.S. Cl. ..... 72/161; 72/205
(58) Field of Search ..... 72/161, 160, 205

(56) References Cited

U.S. PATENT DOCUMENTS 3,777,532 * 12/1973 Noe ..... 72/205
3,924,428 * 12/1975 Noe ..... 72/205
4,651,549 * 3/1987 Masui ..... 72/205
5,161,400 * 11/1992 Lefor ..... 72/205

* cited by examiner

*Primary Examiner*—Daniel C. Crane
(74) *Attorney, Agent, or Firm*—Arent Fox Kintner Plotkin & Kahn, PLLC

(57) ABSTRACT

A leveling technique that produces a high degree of flatness of strips and gives strips a characteristic such that parts cut from the strips by etching do not warp. Also, a method of leveling strips including the steps of rectifying a trip by tensioning and bending the strip with a tension leveler. The load acting on the strip by the tensioning and bending being 70% or more of the yield or proof stress of the strip. The method also including rectifying the strip by tensioning the strip with a roller leveler. The tension acting on the strip by the roller leveler being 50 N/mm$^2$ or less.

6 Claims, 4 Drawing Sheets

METHOD OF LEVELING STRIPS AND LEVELING EQUIPMENT OF STRIPS

BACKGROUND OF THE INVENTION

The present invention relates to a method of leveling strips and a leveling equipment of strips.

Required of strips for the production of parts for electrical and electronic apparatus are a high degree of flatness and a characteristic that parts cut out from the strips by etching do no warp. The present invention relates to a technique for rectifying the shapes of strips so that the rectified strips meet the two requirements.

The following prior arts for rectifying the shapes of strips are available.

(1) Method of rectifying the shapes of strips with a tension leveler

By using this method, the flatness of the strip can be improved below 0.5% in terms of the ratio of the height of a circular arc to the length of its chord, but the residual stress in the strip is high, causing parts cut out from the strip by etching to warp to a significant degree.

(2) Method of rectifying the shapes of strips by low-temperature annealing

By using this method, the residual stress in the strip can be reduced below 50 N/mm$^2$ so that parts cut out from the strip develop no substantial warps, but the flatness of the strip is over 1.0% in terms of the ratio of the height of a circular arc to the length of its chord.

In accordance with the above, the object of the present invention is to provide a leveling method and a leveling technique which secure a high degree of flatness of strips and give strips a characteristic that parts cut out from them by etching do not warp.

SUMMARY OF THE INVENTION

According to the first aspect of the present invention, there is provided a method of leveling strips, which comprises the steps of (i) rectifying a strip by tensioning and bending it with a tension leveler, the load acting on the strip being 70% or more of the yield, or proof, stress of the strip and (ii) rectifying the strip by tensioning it with a roller leveler, the tension acting on the strip being 50 N/mm$^2$ or less.

According to the second aspect of the present invention, there is provided a leveling equipment of strips, which comprises (i) entry bridle rollers, center bridle rollers, and exit bridle rollers, (ii) a tension leveler disposed between the entry bridle rollers and the center bridle rollers, and (iii) a roller leveler disposed between the center bridle rollers and the exit bridle rollers.

According to the third aspect of the present invention, there is provided the leveling equipment of strips, wherein the diameters of the rollers of the tension leveler are 450 or more times the thickness of a strip to be rectified.

The advantages offered by the first aspect of the invention are as follows. By applying a load of 70% or more of the yield, or proof, stress of a strip while it is going through the tension leveler, the development of residual stress in the strip can be suppressed. Besides, by applying tension of 50 N/mm$^2$ or less to the strip while it is going through the roller leveler, the residual stress in the strip developed in the tension leveler can be reduced.

The advantage offered by the second aspect of the invention is as follows. While a strip is being rectified with the tension leveler, a load of 70% or more of the yield, or proof, stress of the strip can be applied to it with the entry and center bridle rollers. Then, while the strip is being rectified with the roller leveler, the tension acting on the strip can be adjusted to 50 N/mm$^2$ or less with the center and exit bridle rollers. Thus, the leveling method of the first aspect of the invention can be implemented.

The advantage offered by the third aspect of the invention is as follows. Because the radius of curvature of a strip on each roller in the tension leveler is large, a load of 70% or more of the yield, or proof, stress of the strip can be applied to it.

BRIEF DESCRIPTION OF THE DRAWINGS

The features and advantages of the present invention will become more clearly appreciated from the following description in conjunction with the accompanying drawings, in which.

DETAILED DESCRIPTION OF THE PREFERRED EMBODIMENT

With reference to the drawings, a preferred embodiment of the present invention will now be described.

Figure 1:
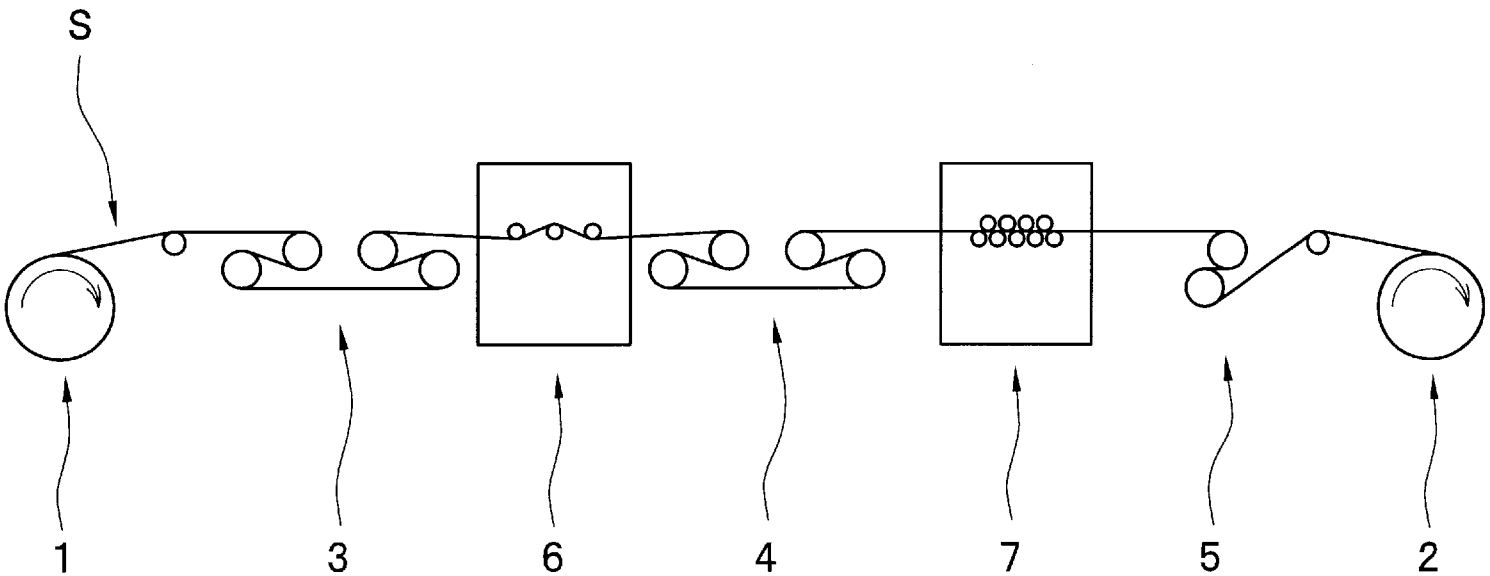
FIG. 1 is a schematic illustration of an embodiment of leveling equipment of strips of the present invention.

In FIG. 1, the numeral 1 indicates a payoff reel, which sends out a strip S. The numeral 2 represents a tension reel, which applies tension to the strip S and winds up the rectified strip S. Disposed between the payoff reel 1 and the tension reel 2 are entry bridle rollers 3, center bridle rollers 4, and exit bridle rollers 5. A tension leveler 6 is disposed between the entry bridle rollers 3 and the center bridle rollers 4. A roller leveler 7 is disposed between the center bridle rollers 4 and the exit bridle rollers 5.

Figure 2:
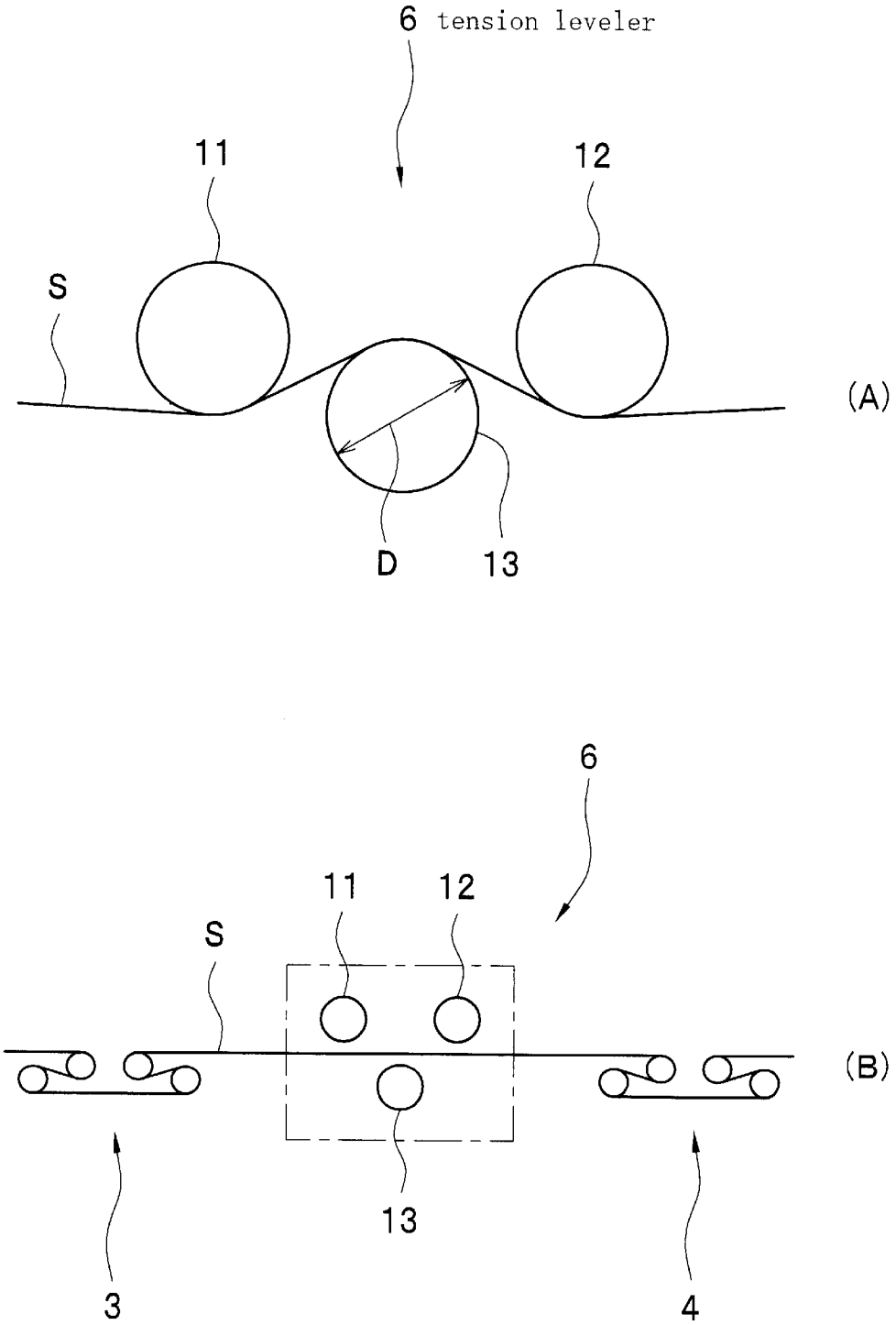
FIG. 2(A) is an illustration of the tension leveler 6 of FIG. 1.
FIG. 2(B) is an illustration of the arrangement of rollers of the tension leveler 6 in simple tensioning.

Comprising an entry deflector roller 11, an exit deflector roller 12, and a work roller 13 as shown in FIG. 2(A), the tension leveler 6 is operated as a so-called high-tension tension leveler.

The diameter D of each roller is 450 or more times the thickness of the strip S.

In this tension levelers 6, the strip S is bent and rectified by the entry and exit deflector rollers 11 and 12 and the work roller 13 as shown in FIG. 2(A), or the strip S is simply tensioned and rectified by the entry and center bridle rollers 3 and 4, the rollers 11, 12, and 13 retreating from the strip S, as shown in FIG. 2(B).

The roller leveler 7 is a known roller leveler and operated as a so-called low-tension roller leveler. Therefore, its upper and lower rollers are arranged in zigzag. The upper rollers may individually be adjusted upward and downward, or the upper rollers may, as a unit, be adjusted upward and downward. Besides, pinch rollers may be provided at the entry and the exit of the roller leveler 7. Moreover, other configurations can be adopted without any particular limitation.

Now, the operation of the leveling equipment will be described.

A strip S goes from the payoff reel 1 through the tension leveler 6 and the roller leveler 7 to the tension reel 2, which winds up the strip S.

In the tension leveler 6, the strip S is given tension by the entry and center bridle rollers 3 and 4 to be rectified for flatness. The tension on and the bending curvature of the strip S are adjusted so that the load on the strip S becomes 70% or more of its yield, or proof, stress. Under the condition, the residual stress in the strip S due to the rectification by the tension leveler 6 is suppressed.

As described above, the leveling load can be raised to 70% or more of the yield, or proof, stress of the strip S by stretching it simply or by giving the rollers 11, 12, and 13 a diameter of 450 or more times the thickness of the strip S. In other words, the leveling load can be attained by making the radius of curvature of the strip S infinitely large or large enough.

Figure 3:
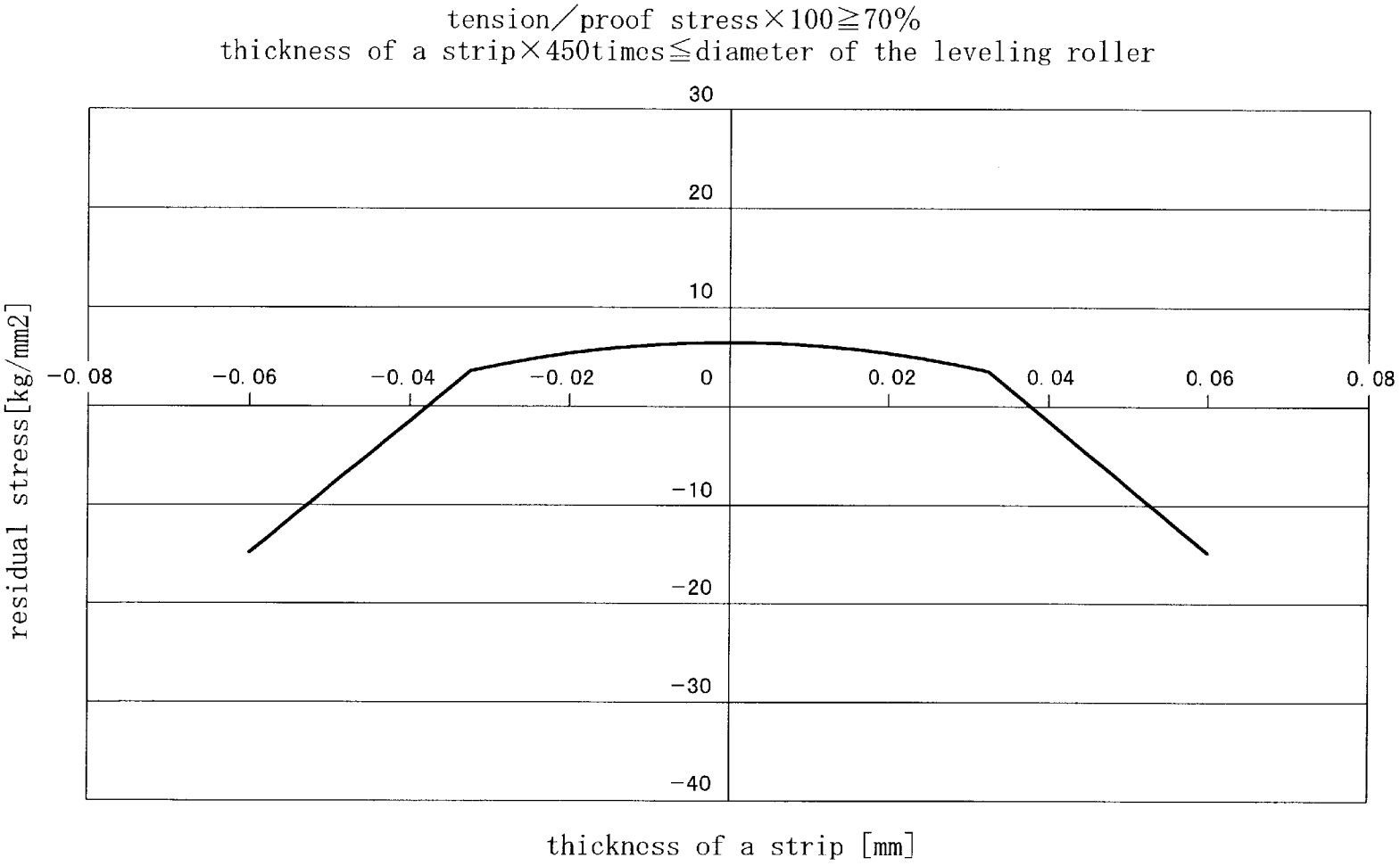
FIG. 3 shows the residual stress in case that the diameters of the rollers of the tension leveler are 450 or more times the thickness of a strip.
Figure 4:
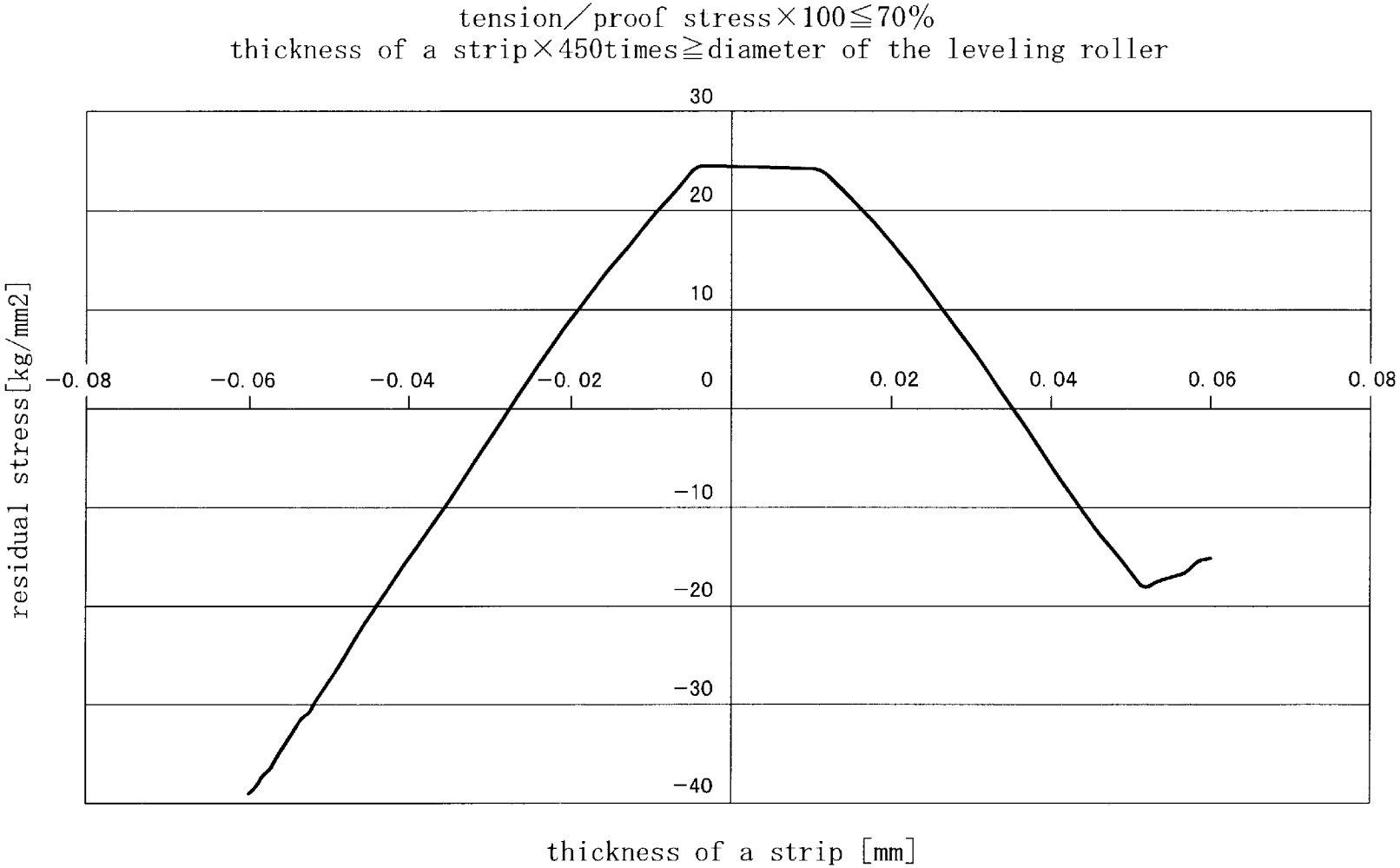
FIG. 4 shows the residual stress in case that the diameters of the rollers of the tension leveler are below 450 times the thickness of a strip.

FIG. 3 shows the residual stress in case that the diameters D of the rollers of the tension leveler 6 are 450 or more times the thickness of the strip S; FIG. 4, the residual stress in case that the diameters D of the rollers of the tension leveler 6 are below 450 times the thickness of the strip S. The former residual stress is about one fourth of the latter residual stress.

Then, the strip S is rectified in the roller leveler 7 under the tension by the center and exit bridle rollers 4 and 5. Because the tension is as low as below 50 $N/mm^2$, the residual stress in the strip S caused by the tension leveler 6 is reduced.

As described above, in accordance with the leveling method of the present invention, the residual stress in strips can be reduced, and therefore parts for electrical and electronic apparatus cut out from the strips by etching do not warp.

The invention may be embodied in other specific forms without departing from the spirit or essential characteristics thereof. The above embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What we claim is:

1. A method of leveling strips comprising the steps of:

rectifying a strip by tensioning and bending it with a tension leveler, the load acting on the strip being 70% or more of the yield, or proof, stress of the strip; and rectifying the strip by tensioning it with a roller leveler, the tension acting on the strip being 50 $N/mm^2$ or less.

2. A leveling equipment of strips as claimed in claim 1, wherein the tension leveler includes an entry deflector roller, an exit deflector roller, and a work roller.

3. A leveling equipment of strips as claimed in claim 1, wherein the roller leveler includes upper and lower rollers arranged in zigzag.

4. A leveling equipment of strips as claimed in claim 3, wherein pinch rollers are provided at an entry and exit of the roller leveler.

5. A leveling equipment of strips comprising:

entry bridle rollers, center bridle rollers, and exit bridle rollers;

a tension leveler disposed between the entry bridle rollers and the center bridle rollers; and a roller leveler disposed between the center bridle rollers and the exit bridle rollers, wherein tension provided by the tension leveler to the strips is higher than tension provided by the roller leveler to the strips.

6. A leveling equipment of strips as claimed in claim 5, wherein the diameters of the rollers of the tension leveler are 450 or more times the thickness of a strip to be rectified.

* * * * *